US008210704B1

(12) United States Patent
Parsons

(10) Patent No.: US 8,210,704 B1
(45) Date of Patent: Jul. 3, 2012

(54) ILLUMINATOR FOR COSMETOLOGY SERVICES

(76) Inventor: John E. Parsons, Anchorage, AK (US)

( * ) Notice: Subject to any disclaimer, the term of this patent is extended or adjusted under 35 U.S.C. 154(b) by 237 days.

(21) Appl. No.: 12/798,760

(22) Filed: Apr. 9, 2010

(51) Int. Cl.
*F21V 33/00* (2006.01)

(52) U.S. Cl. ..... 362/108; 362/253; 362/234

(58) Field of Classification Search ..... 362/103, 362/108, 253, 234
See application file for complete search history.

(56) References Cited

U.S. PATENT DOCUMENTS 6,267,482 B1 * 7/2001 Miller et al. ..... 362/103
6,517,214 B1 * 2/2003 Mitchell et al. ..... 362/108
7,117,824 B2 * 10/2006 Holtzworth et al. ..... 119/850
2006/0176680 A1 * 8/2006 Bretz et al. ..... 362/108
2009/0116226 A1 * 5/2009 Wang ..... 362/105
* cited by examiner

*Primary Examiner* — Laura Tso
(74) *Attorney, Agent, or Firm* — Michael J. Tavella

(57) ABSTRACT

A three-part "C" shaped disc of plastic that is placed on a client's shoulders. Several small light bulbs or light emitting diodes (LEDS) are positioned around the apex of the C-shaped disk. The lights are mounted in the disc at a 45-degree angle facing the head to illuminate the lower portions of the head. The lights are mounted in two rows, and are spaced at a distance of a quarter inch apart. This ensures the maximum level of illumination. The top cover can be removed so the LED's can be changed if a light burns out. The power is supplied by an AC outlet and converted to 12 volt DC. The device also has two wing lights that are used to illuminate the sides of the head.

17 Claims, 11 Drawing Sheets

ILLUMINATOR FOR COSMETOLOGY SERVICES

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to lighting systems and particularly to lighting systems for cosmetology services.

2. Description of the Prior Art

For centuries, barbers and beauticians have worked haircutting, cleaning, coloring and processing it. For much of this time, these workers have their clients seated in chairs, covered by capes. All of the lighting available to the stylist has typically come from overhead lighting fixtures, or occasionally, some lighting around mirrors or some storefront windows. The lighting presently in use is adequate, but lacks the ability to properly illuminate the back of the head and neck. This causes shadows to form around the head and neck. This problem exists in all salons. The crown of the head is lit with light coming from the overhead lighting, but the sides of the head are not well light. Additionally, from the base of the head to the nape of the neck, the lighting is very poor. This makes it hard to judge the work. The stylist is always turning the client back and forth to get the light needed to perform the haircut. This makes the stylist work harder and the haircut not as good or neat as it should be. At best, this is an inconvenience. At worst, it can be hazardous to the client.

BRIEF DESCRIPTION OF THE INVENTION

The instant invention overcomes this difficulty. It is a "C" shaped disc of plastic that is placed on a client's shoulders. The disk has an open front so that it can be placed around a client's head. Several small light bulbs or light emitting diodes (LEDS) are positioned round the apex of the C-shaped disk. The lights are mounted in the disc at a 45 degree angle facing the head, which gives about 80 percent more light from the curve of the head down to the nape of the neck, allowing the stylist to cut the hair with ease.

The C-shaped disc is made in three parts. The first part has a bank of resistors as part of the LED circuit built in. The second disc covers the first disc to protect the resistors; the LED's are mounted in this disk. The third disc is a cover for the lights. The cover is used to protect the lights from moisture and hair. The cover also allows the stylist to clean the unit without damage to the lights. The lights are mounted in two rows, and are spaced at a distance of a quarter inch apart. The top row of lights is placed above the bottom row of lights and is offset from the bottom row of lights. This ensures the maximum level of illumination.

The second disc also has sockets for the LED's. The top cover can be removed so the LED's can be changed if a light burns out. The power is supplied by an AC outlet and converted to 12 volt DC.

The device also has two wing lights that are used to illuminate the sides of the head.

DETAILED DESCRIPTION OF THE INVENTION

Figure 1:
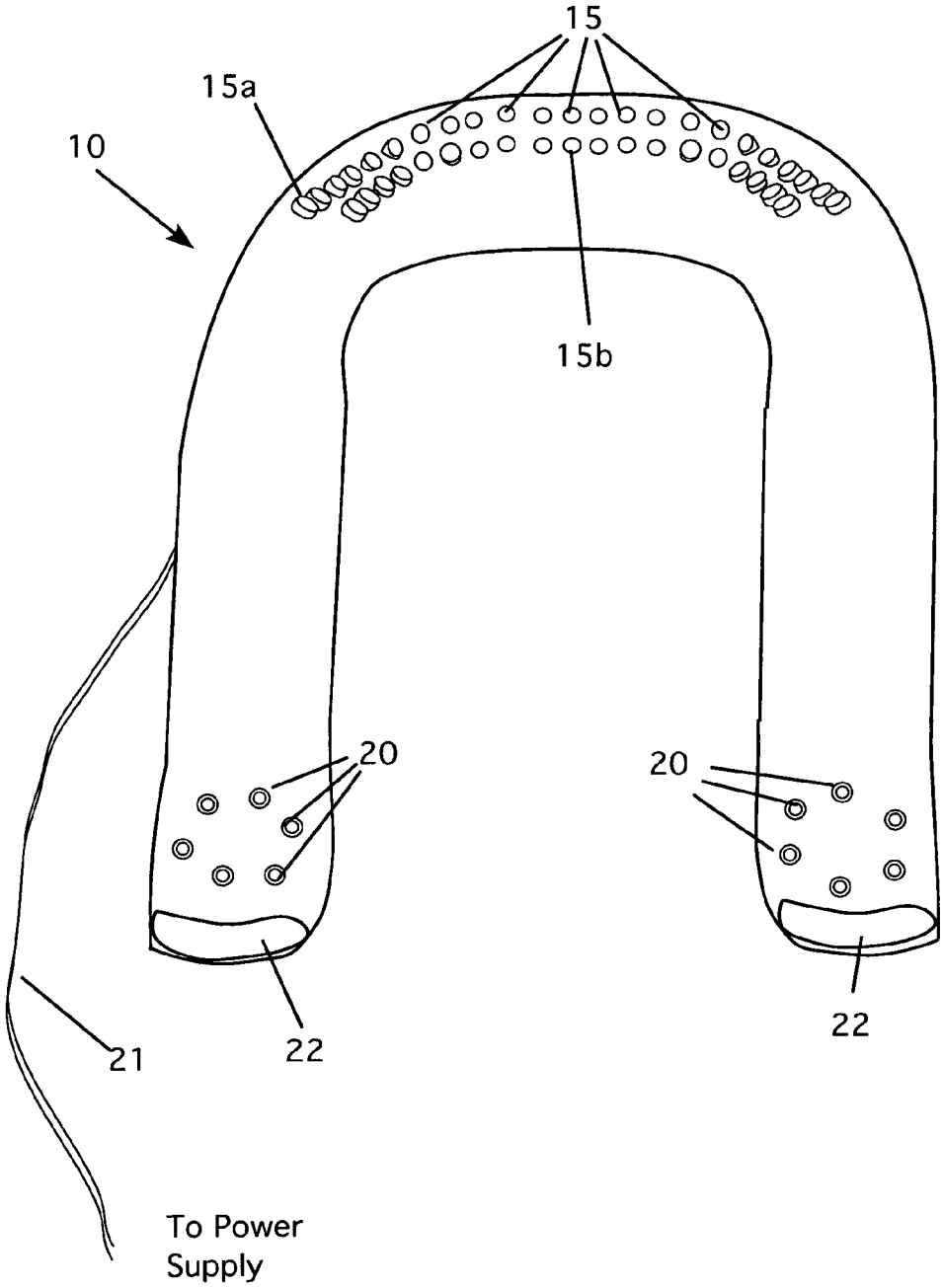
FIG. 1 is a top view of a first embodiment of the invention.
Figure 11:
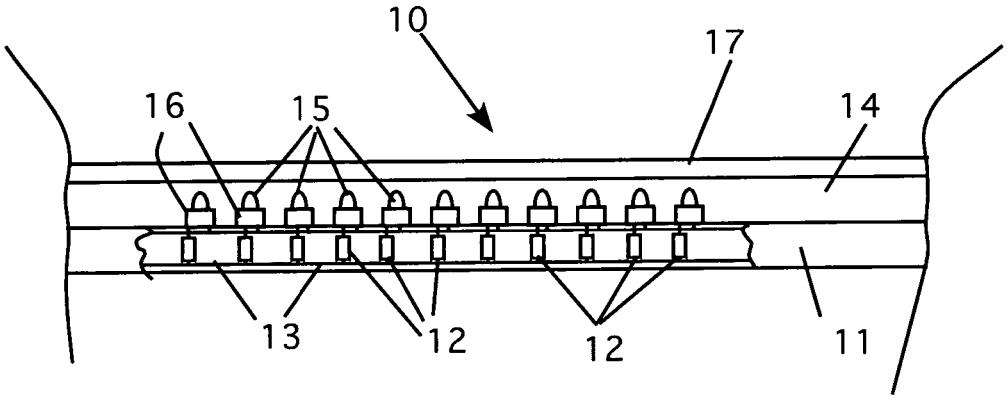
FIG. 11 is a side detail of a portion of the device showing the arrangement of the layers.
Figure 12:
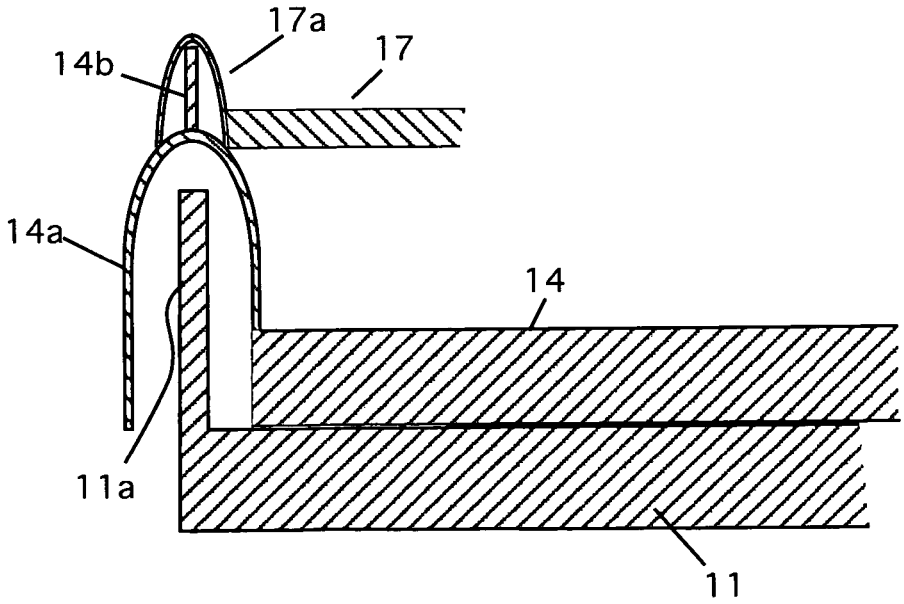
FIG. 12 is an enlarged sectional detail view of an edge of the device showing the interlocking system for the layers.

Referring now to the drawing figures, and particularly FIGS. 1 and 11, a top view of the first embodiment of the invention 10 is shown. The invention is a C-shape disc is made in three parts. The C-shaped disc is made out of Plexiglas. In the preferred embodiment, the disc is 2½" in width. FIG. 11 shows the three layers. The lowest layer 11 has a set of resistors 12 and wiring 13 built in. The second disc 14 covers the first disc to protect the resistors. The second disk has a set of lighting elements 15 mounted in it. These lighting elements are LEDs. The LEDs 15 are placed in sockets 16 that allow individual units to be replaced as needed. The third disc 17 is used as a cover for the lights to protect them from moisture and hair. The cover allows the stylist to clean the device without damage to the lights. Note that the three disks are locked together at the edges with a snap seam, which is shown in FIG. 12, discussed below.

In the preferred embodiment, the lights are mounted in two rows, and are spaced at a distance of about one-quarter inch apart. The top row of lights is placed above the bottom lights. This ensures the maximum level of illumination from the device.

Figure 2:
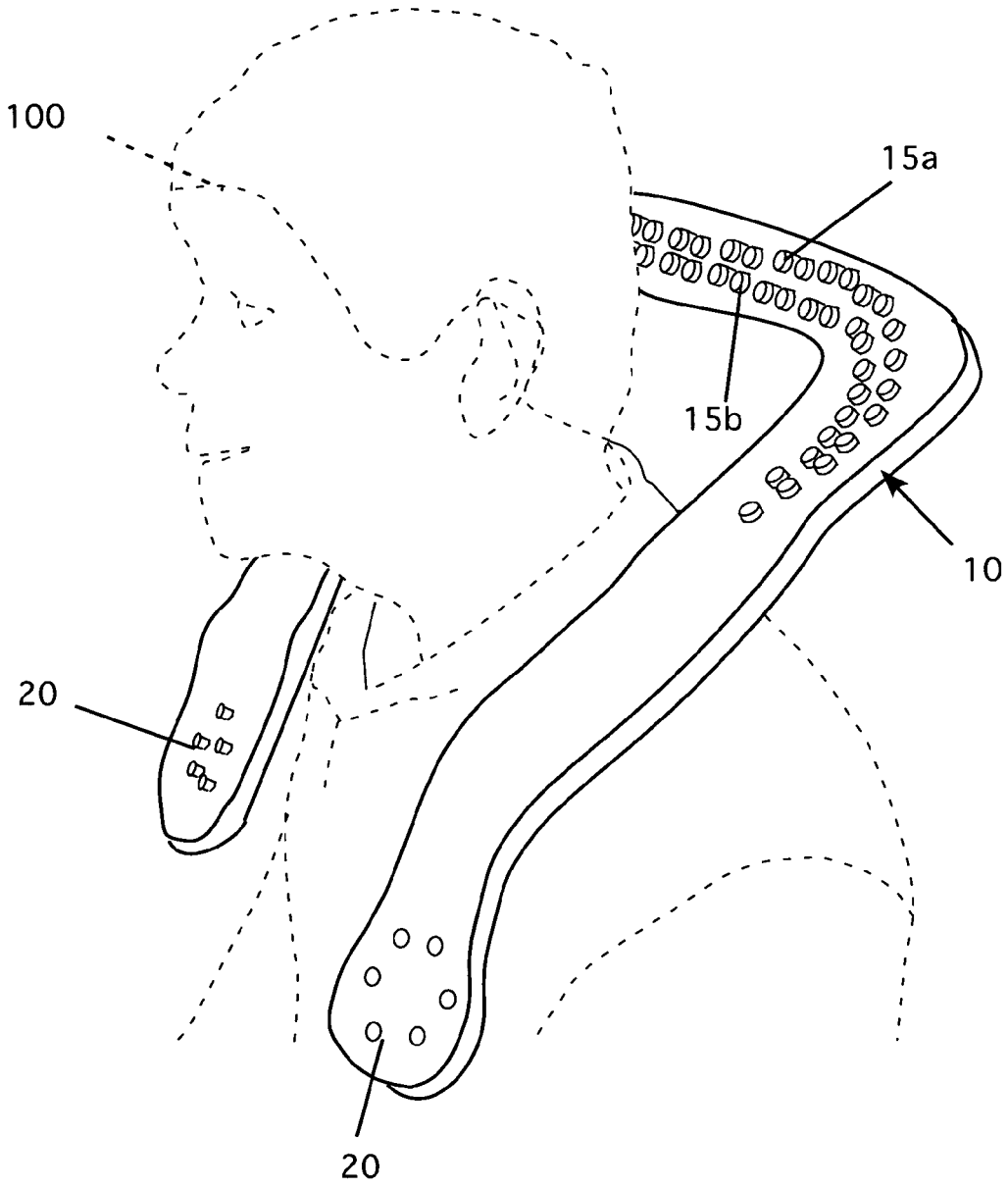
FIG. 2 is a side detail view of a person wearing the first embodiment of the invention.
Figure 3:
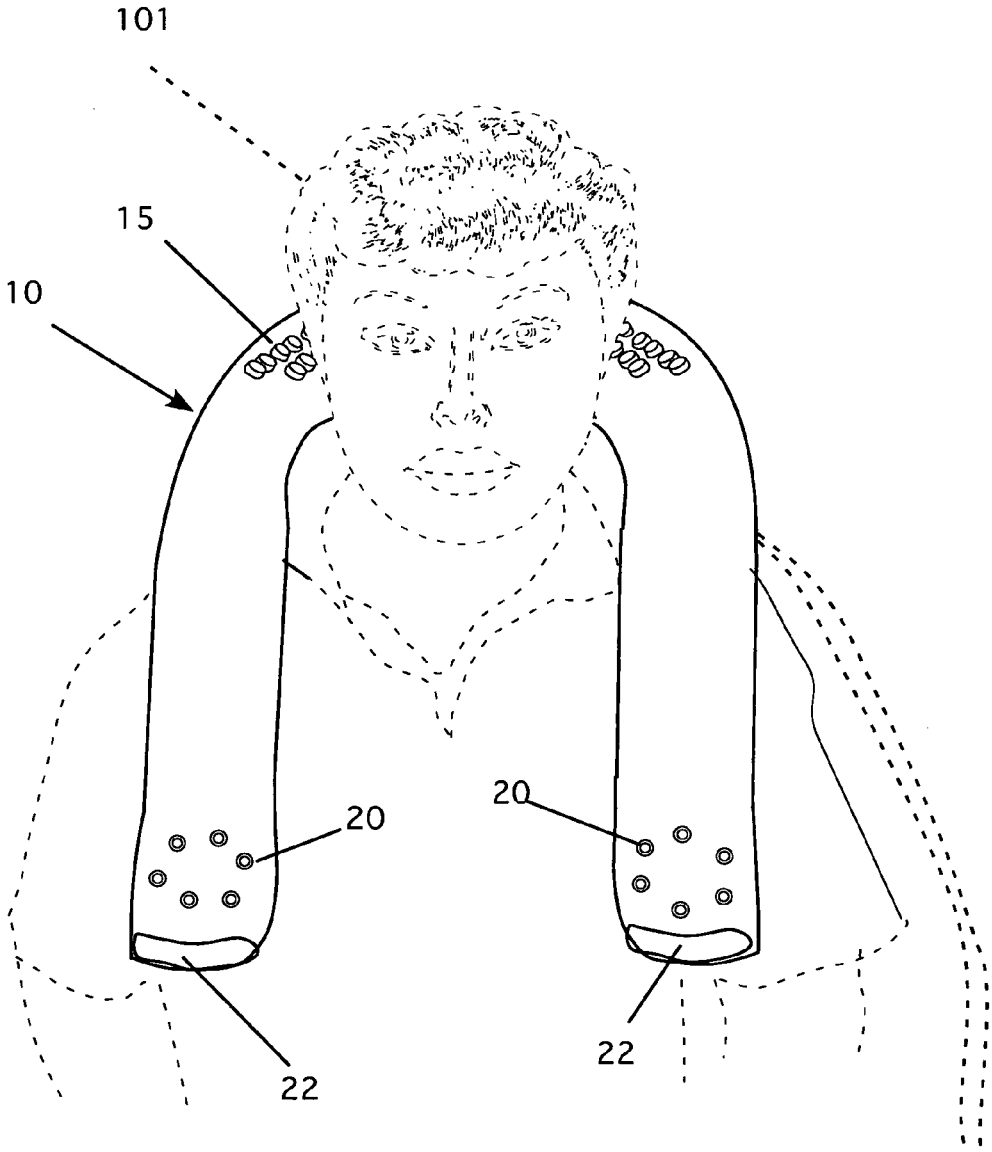
FIG. 3 is a front detail view of a person wearing the first embodiment of the invention.
Figure 4:
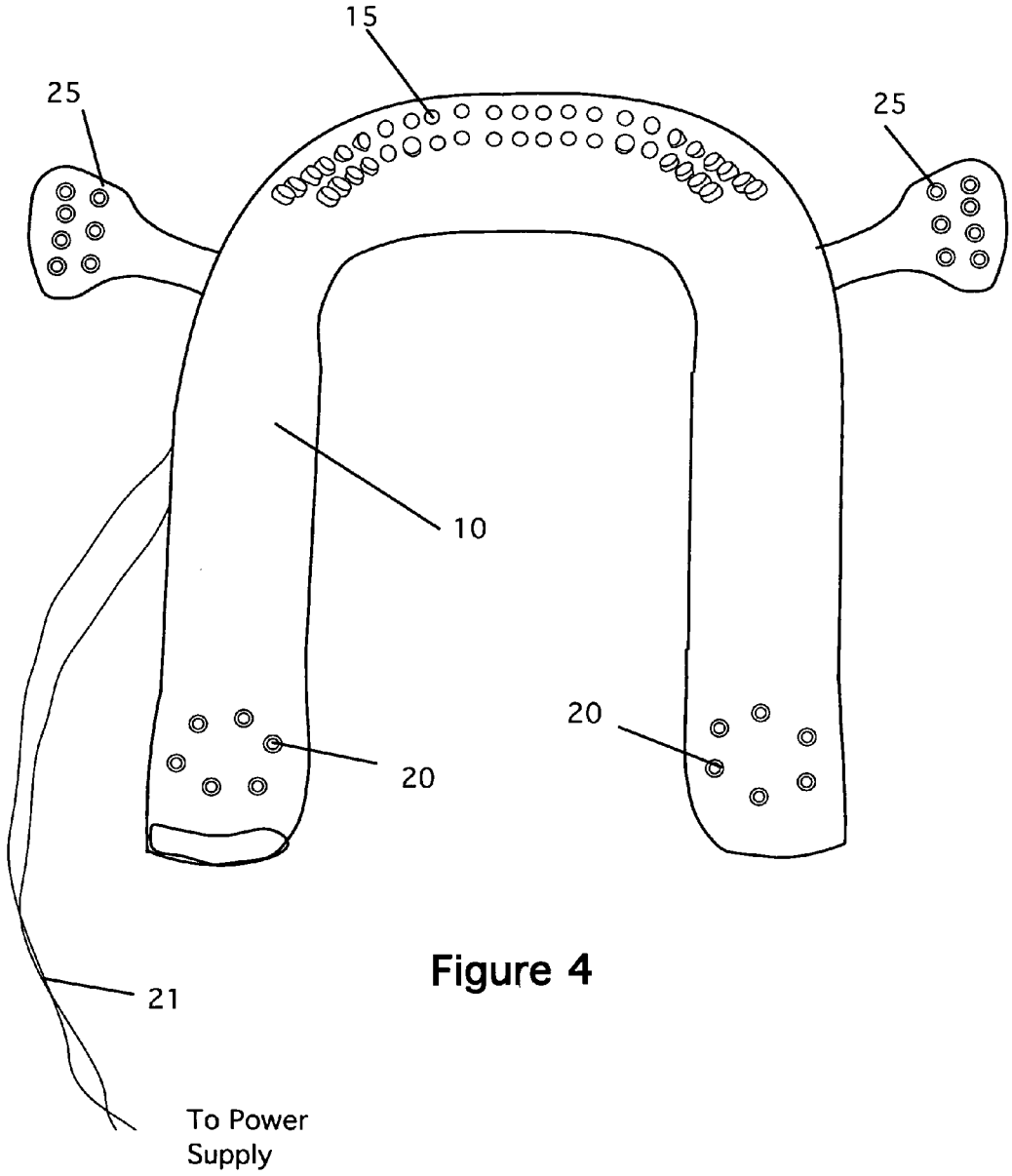
FIG. 4 is a top view of a second embodiment of the invention.
Figure 5:
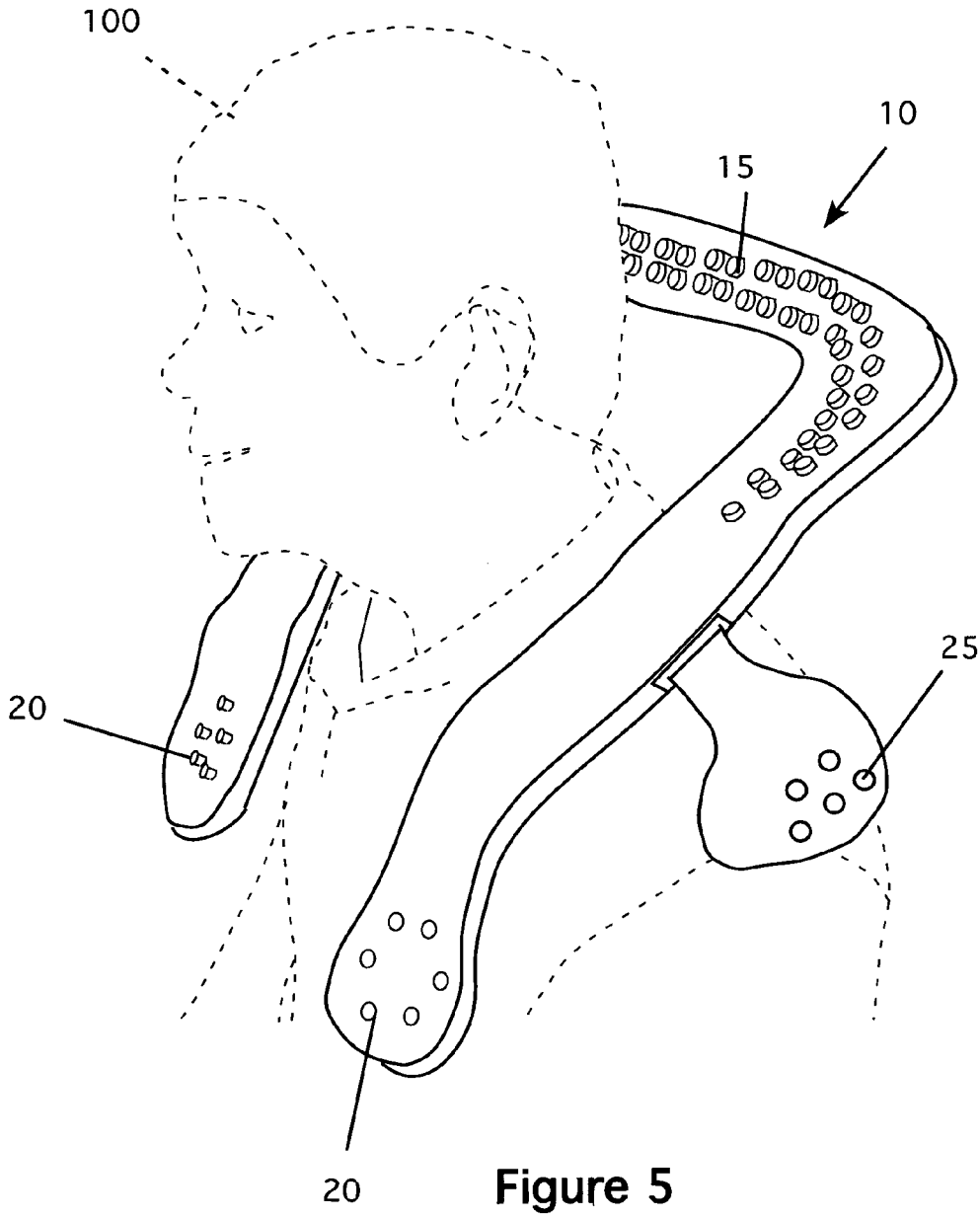
FIG. 5 is a side detail view of a person wearing the second embodiment of the invention showing the wing lights in the lowered position.

As shown in FIGS. 2 and 3, the preferred embodiment has two rows of lights. The bottom row 15*a* is used to light up the lower part of the head and the upper row of lights 15*b* is used to light up the upper part of the head. Together they cover the head from the nape to the curve of the top of the head of a user 100. The lights are positioned at an angle of about 40 to 45 degrees. In the preferred embodiment, the number of lights in each row is 21 but this can be more or fewer. The number depends on the power and physical size of the lights.

As shown in the FIGS. 1 and 2, there are also 6 secondary lights 20 on each end of the disc. They are for the client to enjoy. In the preferred embodiment, they are designed to slowly pulsate, which also helps the client relax during the hair treatment.

Power is supplied by wires 21 that come from a DC power supply. See, FIG. 9.

The device also has counter-weights 22 added at the end of each side for balancing the rear of the disc. In the preferred embodiment, the disk is designed to sit back from the nape of the neck approximately 8 inches. This gives the stylists room to work with their hands and tools and still have the light need to cut the hair.

Figure 6:
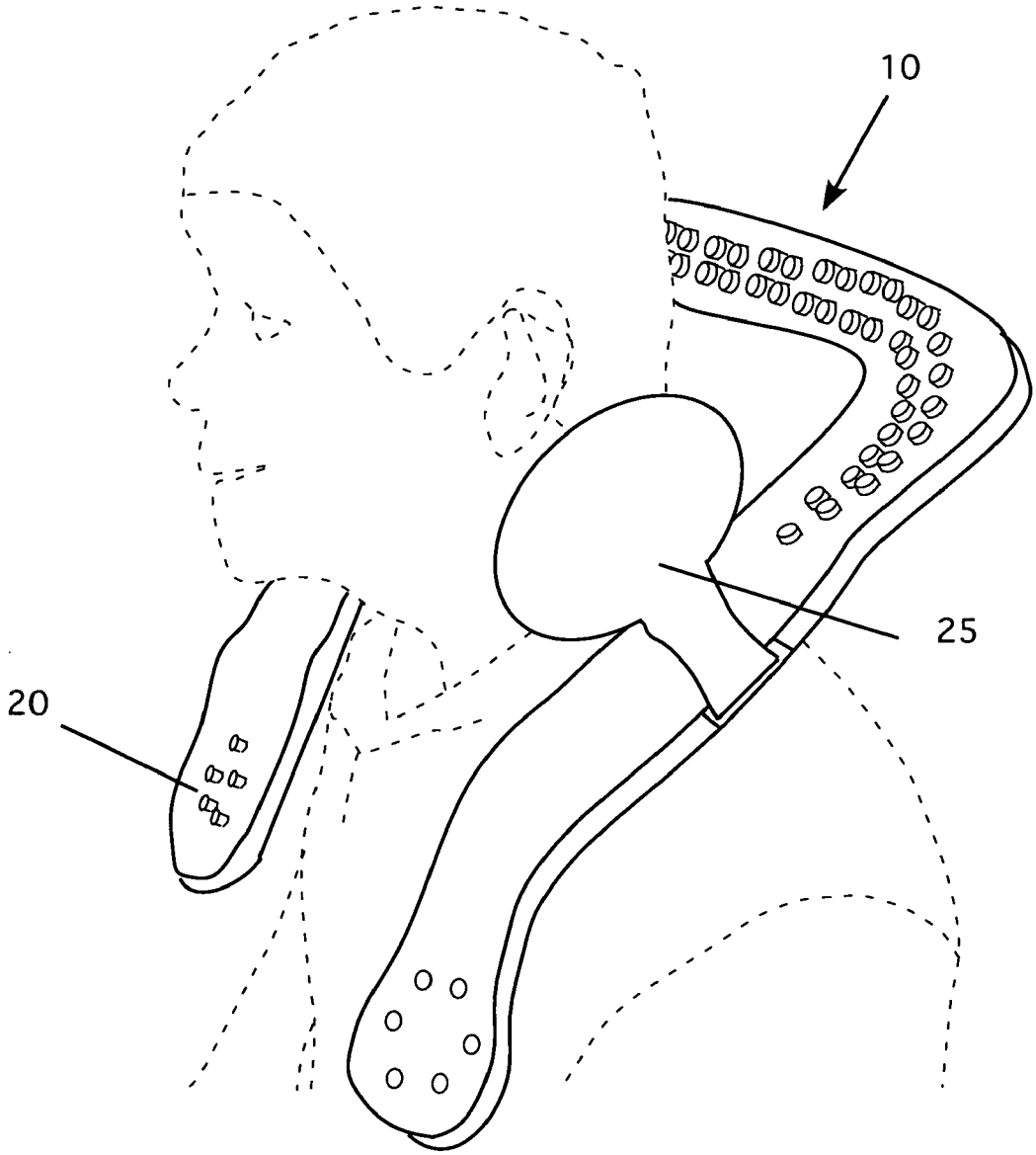
FIG. 6 is a side detail view of a person wearing the second embodiment of the invention showing the wing lights in the raised position.
Figure 7:
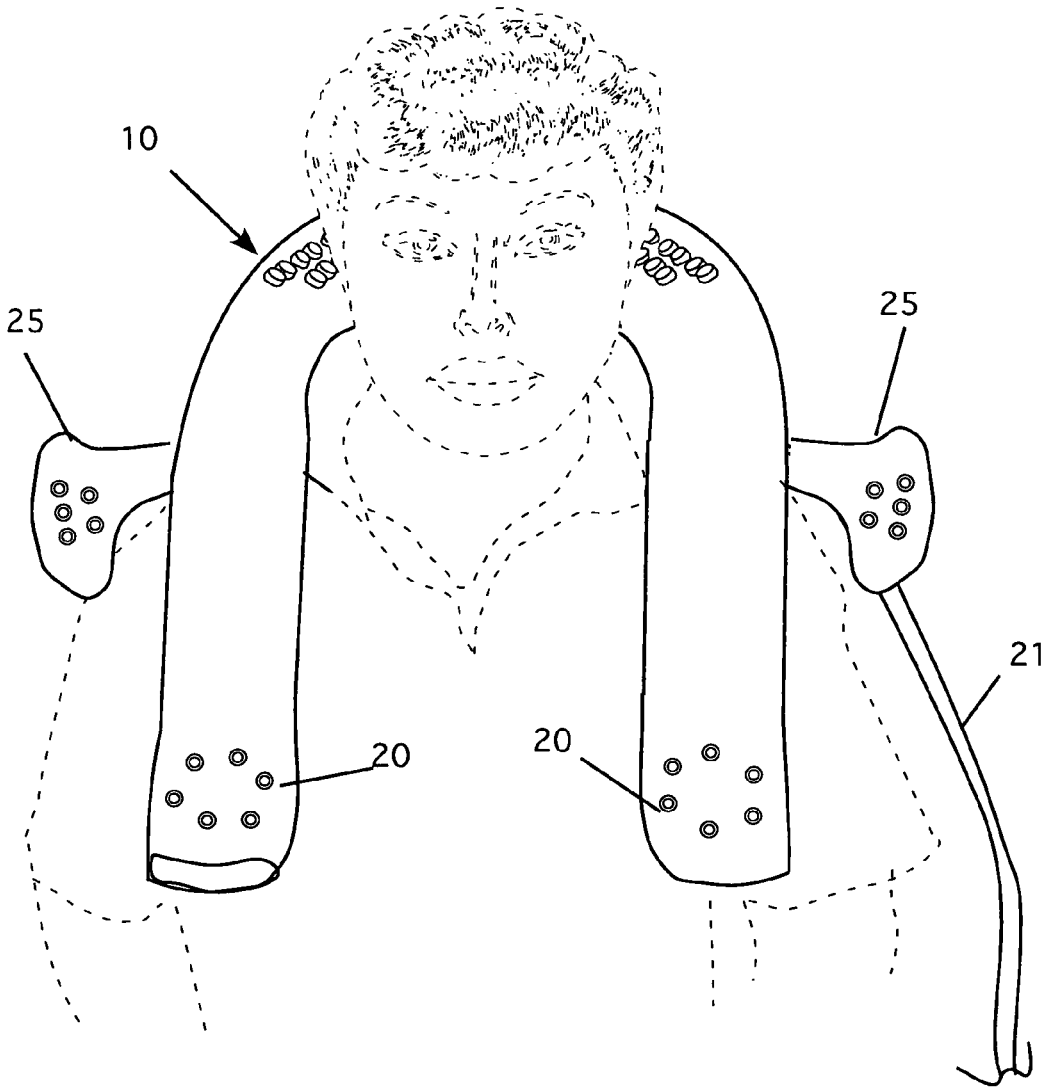
FIG. 7 is a front detail view of a person wearing the second embodiment of the invention showing the wing lights in the lowered position.
Figure 8:
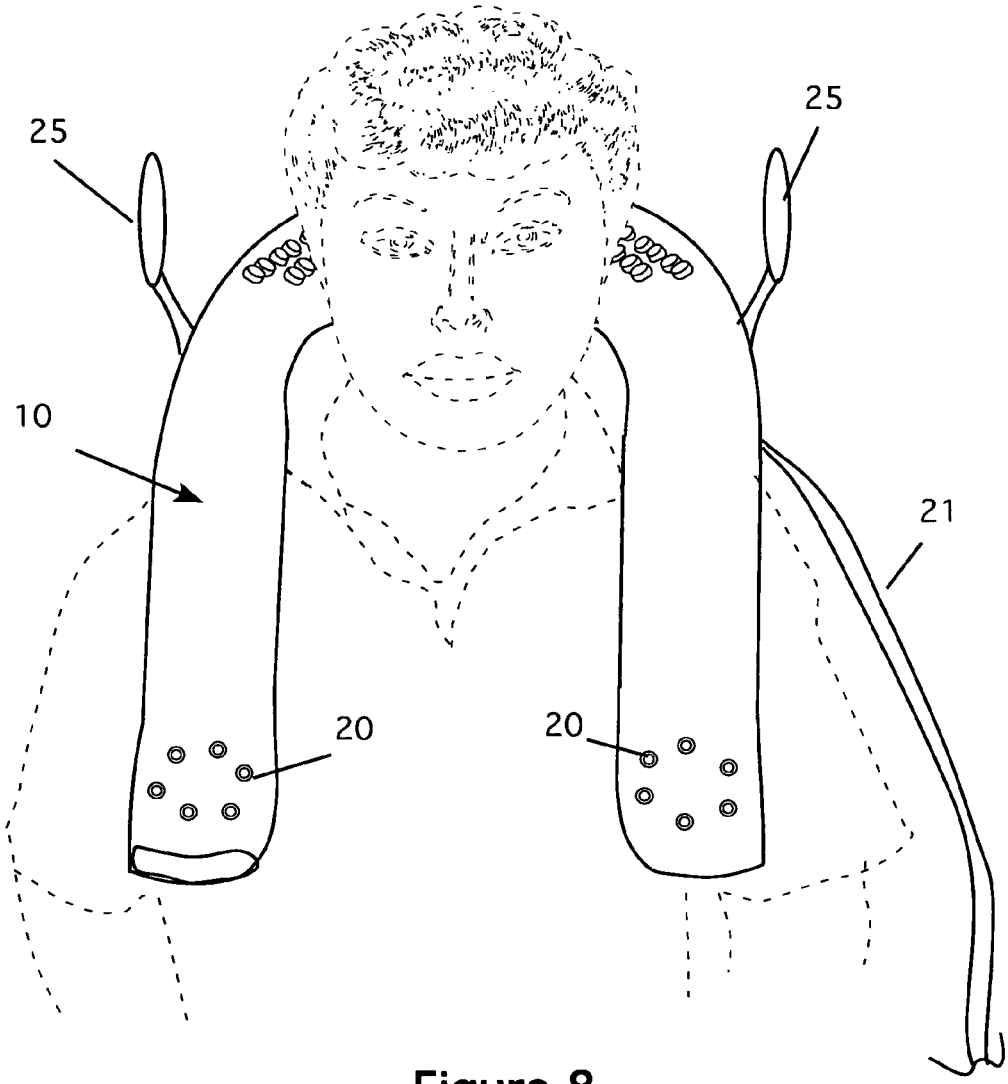
FIG. 8 is a front detail view of a person wearing the second embodiment of the invention showing the wing lights in the raised position.

Referring now to FIGS. 4-8, in the preferred embodiment, separate attachable wing lighting 25 can be added. These wing lights 25 are shown in FIGS. 4-8. Wing lighting is attached to the circular disc 10 and is used to light the side of the head from the ear to the side-burns and from the hairline to the curve of the top of the head (see FIGS. 6 and 8). The wing lighting is designed to rest on the shoulders when not in use (shown in FIGS. 5 and 7). In use, the light can be rotated upwards as shown in FIGS. 6 and 8. When in use, the wing 25 stands about 5" high and 3"½ in width. It has three lights at the top and two at the bottom. The structure for the wing lighting is the same as the main disk. The wings are also adjustable to variable angles to light the portion of the head from the ear to the sideburns, as well as the curve of the head. The wings plug into the C-shape disc for their power source.

In the preferred embodiment, the main LEDs are 8 mm and rated from 5000 to 8000 MCD (MilliCandela). As an option, on the sides of the wing lighting smaller 5 mm LEDs rated at 1100 MCD can be also added for customer viewing.

Figure 9:
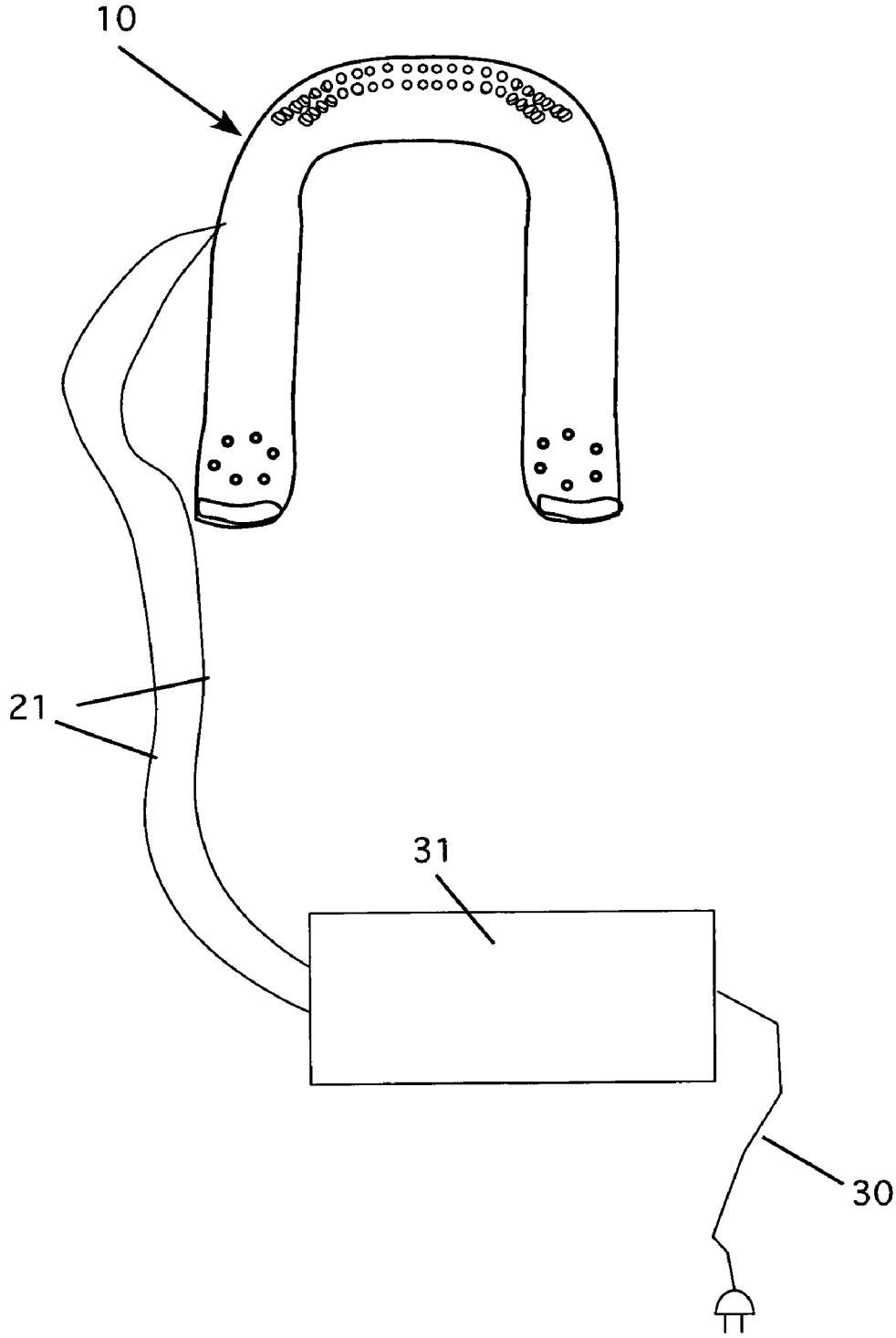
FIG. 9 is a top view of the invention showing the DC power supply.

Referring now to FIG. 9, the power is supplied from standard 120 V-AC converted to 12 V DC. The power is fed from a cord 30 to the power converter 31. The output of the converter is supplied to the device with wires 21, as discussed above. The output of the converter must be sufficient to power all of the LEDs in the circuit.

Figure 10:
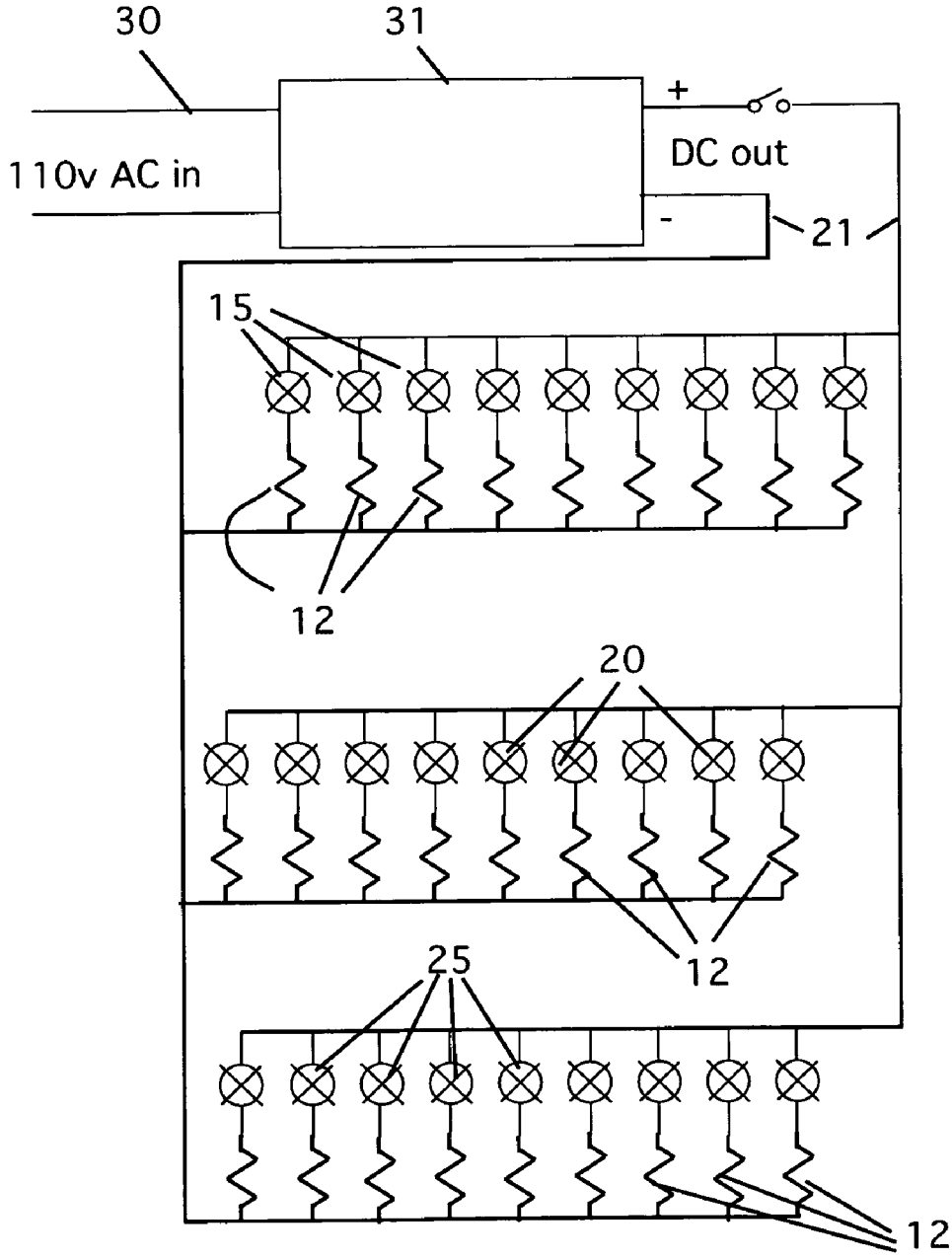
FIG. 10 is a schematic wiring diagram of the lighting system.

FIG. 10 shows a representative wiring diagram. The diagram shows the AC input 31, the DC converter 32 and the DC output 21. The diagram shows the main lighting 15, the secondary lighting 20 and the wing lighting 25. Note that the diagram is simplified and does not show each and every LED used on the device. However all LEDs are wired in parallel circuits and someone of ordinary skill can easily wire additional LEDs by simply expanding the circuits using ordinary techniques. In the preferred embodiment, the resistors are 470 ohms each and rated at ⅛ watts.

Finally, FIG. 12 shows the snap seam for the three parts of the device. At the bottom is the resistor section 11. It has a ridge 11*a* formed at its edge as shown. The center section 14 is placed over section 11. It has a curved portion 14*a* that snaps onto the ridge 11*a*. The curved portion 14*a* also has a ridge 14*b* that extend upward as shown. At the top is the cover 17, which has a curved portion 17*a* that snaps over the ridge 14*a*. The design is intended to seal the three parts to prevent the entry of moisture or debris into the device.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An illuminator for cosmetology services comprising:

a) a C-shaped disc, wherein said C-shaped disk is designed to fit around a user's neck and has a curved rear portion and two shoulder portions having ends;

b) a plurality of lighting elements installed in said C-shaped disk, positioned such that said plurality of lighting elements illuminates the rear portion of said user's head;

c) a pair of separate, detachable, rotatable, wing lighting portions attached to said C-shaped disc; and d) a means for supplying power to said plurality of lighting elements.

2. The illuminator of claim 1 wherein the C-shaped disc is made out of Plexiglas.

3. The illuminator of claim 1 wherein the C-shaped disc is formed of three layers.

4. The illuminator of claim 3 wherein one of said three layers has a set of resistors installed therein.

5. The illuminator of claim 3 wherein the second of said three layers contains said plurality of lighting elements.

6. The illuminator of claim 3 wherein the third of said three layers is used as a cover for the lights.

7. The illuminator of claim 3 wherein the three layers further include a snap-together seam formed at the edge of said three layers.

8. The illuminator of claim 1 wherein the plurality of lighting elements in said C-shaped disk are positioned at an angle of about 40 to 45 degrees with respect to a horizontal plane.

9. The illuminator of claim 1 wherein the plurality of lighting elements are light emitting diodes.

10. The illuminator of claim 1 further comprising a plurality of secondary lights installed in the ends of each of the two shoulder portions of said C-shaped disk.

11. The illuminator of claim 1 wherein the means for supplying power to said plurality of lighting elements includes a DC power supply.

12. The illuminator of claim 1 further comprising a pair of counterweights 22 one of said pair of counterweights being installed in each of the ends of the two shoulder portions of said C-shaped disk.

13. The illuminator of claim 1 wherein the curved portion of said C-shaped disk is positioned approximately 8 inches behind a nape of a user's neck during use.

14. The illuminator of claim 1 wherein the a pair of wing lighting portions is positioned to illuminate each side of the head of a user from the ear to the side-burns and from the hairline to the curve of the top of the head.

15. The illuminator of claim 1 wherein the pair of wing lighting portions is designed to rest on the user's shoulders when not in use.

16. The illuminator of claim 1 wherein the pair of wing lighting portions is designed to rotate upward to a vertical position for use.

17. The illuminator of claim 1 wherein the vertical position of the pair of wing lighting portions extends from about 45 degrees from vertical to about zero degrees from vertical.

* * * * *